US008398135B2

(12) United States Patent
Petty

(10) Patent No.: US 8,398,135 B2
(45) Date of Patent: Mar. 19, 2013

(54) POLE SAFETY ASSEMBLY

(75) Inventor: Clifford D. Petty, Mooresville, IN (US)

(73) Assignee: D B Industries, Inc., Red Wing, MN (US)

( * ) Notice: Subject to any disclaimer, the term of this patent is extended or adjusted under 35 U.S.C. 154(b) by 582 days.

(21) Appl. No.: 12/629,314

(22) Filed: Dec. 2, 2009

(65) Prior Publication Data

US 2010/0213004 A1 Aug. 26, 2010

Related U.S. Application Data

(60) Provisional application No. 61/173,241, filed on Apr. 28, 2009, provisional application No. 61/208,351, filed on Feb. 24, 2009.

(51) Int. Cl.
*B66F 19/00* (2006.01)

(52) U.S. Cl. ..... 294/191; 294/174; 294/209; 182/230

(58) Field of Classification Search ..... 182/230; 294/19.1, 24, 129 R, 191, 277, 174, 209
See application file for complete search history.

(56) References Cited

U.S. PATENT DOCUMENTS

| | | | | | |
|---|---|---|---|---|---|
| 373,289 | A | | 11/1887 | Hart | |
| 441,113 | A | | 11/1890 | Sostmann | |
| 531,347 | A | | 12/1894 | Varney | |
| 650,589 | A | * | 5/1900 | Randle | 294/24 |
| 1,938,419 | A | | 12/1933 | Freidlein | |
| 2,438,121 | A | | 3/1948 | Hubbard | |
| 2,484,278 | A | | 10/1949 | Fisher | |
| 2,776,162 | A | * | 1/1957 | Bitz et al. | 294/23 |
| 2,811,127 | A | * | 10/1957 | Palsson | 114/221 R |
| 2,813,736 | A | * | 11/1957 | Archer et al. | 289/17 |
| 2,879,963 | A | | 3/1959 | Burgess et al. | |
| 3,072,429 | A | | 1/1963 | Stipan | |
| 3,182,960 | A | | 5/1965 | French | |
| 3,600,784 | A | | 8/1971 | Propst et al. | |
| 3,647,171 | A | * | 3/1972 | Rafferty | 248/231.85 |
| 3,677,597 | A | * | 7/1972 | Stipek | 294/209 |
| 3,774,953 | A | | 11/1973 | Babcock | |
| 3,840,091 | A | * | 10/1974 | Conlon | 182/9 |

(Continued)

FOREIGN PATENT DOCUMENTS

| | | |
|---|---|---|
| DE | 202 17 055 U1 | 1/2003 |
| FR | 2 448 355 | 9/1980 |

(Continued)

OTHER PUBLICATIONS

North Safety Products. North Fall Protection ISO 9001, 2003, Carabiners & Hooks, p. 37.

(Continued)

*Primary Examiner* — Katherine Mitchell
*Assistant Examiner* — Colleen M Chavchavadze
(74) *Attorney, Agent, or Firm* — IPLM Group, P.A.

(57) ABSTRACT

A safety assembly that provides a lifeline for utility poles and other tall structures is provided. The safety assembly includes a tubular member and a positioning member. The tubular member has first and second openings to a passage. The passage is configured to receive a rope. The positioning member has a first end and a second end. The first end of the positioning member is configured to be received in at least one of the first and second openings of the tubular member. The second end of the positioning member is configured to be coupled to a reaching member. With the use of the positioning member and the reaching member, the tubular member is positioned to engage the tall structure and the rope passing through the internal passage is used as a lifeline.

20 Claims, 13 Drawing Sheets

U.S. PATENT DOCUMENTS

| | | | | | |
|---|---|---|---|---|---|
| 3,841,685 | A | * | 10/1974 | Kolodziej | 294/100 |
| 3,878,808 | A | * | 4/1975 | Mock, Jr. | 114/230.25 |
| 3,893,005 | A | * | 7/1975 | Corbin | 361/212 |
| 3,918,385 | A | * | 11/1975 | Wallace | 114/230.25 |
| 3,945,335 | A | * | 3/1976 | Kratz | 114/221 R |
| 3,959,869 | A | | 6/1976 | Wyman et al. | |
| 3,968,858 | A | | 7/1976 | Vollan et al. | |
| 4,230,357 | A | | 10/1980 | Bosch et al. | |
| 4,417,398 | A | | 11/1983 | Steck | |
| 4,446,944 | A | | 5/1984 | Forrest et al. | |
| 4,635,986 | A | * | 1/1987 | Johns | 294/209 |
| 4,719,826 | A | * | 1/1988 | DuBois | 81/53.12 |
| 4,895,407 | A | | 1/1990 | Mozer | |
| 4,904,010 | A | | 2/1990 | Lacey et al. | |
| 5,009,181 | A | * | 4/1991 | Upchurch | 114/230.25 |
| 5,058,306 | A | * | 10/1991 | Sienel | 43/5 |
| 5,082,318 | A | * | 1/1992 | Held et al. | 294/191 |
| 5,096,438 | A | | 3/1992 | Black | |
| 5,116,260 | A | * | 5/1992 | Upchurch | 114/221 R |
| 5,141,074 | A | | 8/1992 | Sulowski et al. | |
| 5,292,160 | A | | 3/1994 | Deichman | |
| 5,415,446 | A | | 5/1995 | Olson et al. | |
| 5,451,730 | A | | 9/1995 | Phillips, Sr. | |
| 5,538,302 | A | * | 7/1996 | Travis | 294/24 |
| 5,564,852 | A | | 10/1996 | Maxwell et al. | |
| 5,593,196 | A | | 1/1997 | Baum et al. | |
| 5,603,389 | A | | 2/1997 | Zemon | |
| 5,622,399 | A | | 4/1997 | Albright | |
| 5,670,927 | A | | 9/1997 | Fennell | |
| 5,699,748 | A | * | 12/1997 | Linskey et al. | 114/221 R |
| 5,704,669 | A | | 1/1998 | Clark | |
| 5,742,220 | A | | 4/1998 | Scherer | |
| 5,799,602 | A | * | 9/1998 | Trillo | 114/221 R |
| 5,878,833 | A | | 3/1999 | Bell | |
| 6,022,059 | A | | 2/2000 | Regamey | |
| 6,079,517 | A | | 6/2000 | Payne | |
| 6,241,045 | B1 | | 6/2001 | Reeve et al. | |
| 6,467,823 | B1 | | 10/2002 | Brekken | |
| 6,471,269 | B1 | * | 10/2002 | Payne | 294/99.1 |
| 6,474,197 | B1 | | 11/2002 | Browen et al. | |
| 6,553,871 | B2 | | 4/2003 | Sawyer et al. | |
| 6,725,745 | B1 | | 4/2004 | Palmieri | |
| 6,752,242 | B1 | | 6/2004 | Whitehead et al. | |
| 6,860,532 | B1 | | 3/2005 | Potenzone | |
| 7,181,995 | B2 | | 2/2007 | Rider | |
| 7,185,561 | B1 | | 3/2007 | Eastman | |
| 7,712,804 | B2 | * | 5/2010 | Leyden et al. | 294/191 |
| 7,866,273 | B2 | * | 1/2011 | Schlotterback et al. | 114/230.26 |
| 8,104,811 | B2 | * | 1/2012 | Seguin et al. | 294/209 |

FOREIGN PATENT DOCUMENTS

| | | | |
|---|---|---|---|
| GB | 2 241 257 | A | 8/1991 |
| JP | 2005-224092 | A | 8/2005 |
| WO | WO 95/31251 | | 11/1995 |

OTHER PUBLICATIONS

Ontario Ministry of Labour. Advisory: Shepherd's Hook. [online], [retrieved May 7, 2009], <http://www.labour.gov.on.ca/english/hs/adv_shep_hook.html>.

We Build Ontario—Ontario General Contractors Association, Industry Bulletin 09-01, "Shepherd's Hooks Banned". Jul. 18, 2008.

Search Report from corresponding PCT Application Serial No. PCT/US2010/022795 mailed May 3, 2010.

* cited by examiner

FIG. 1
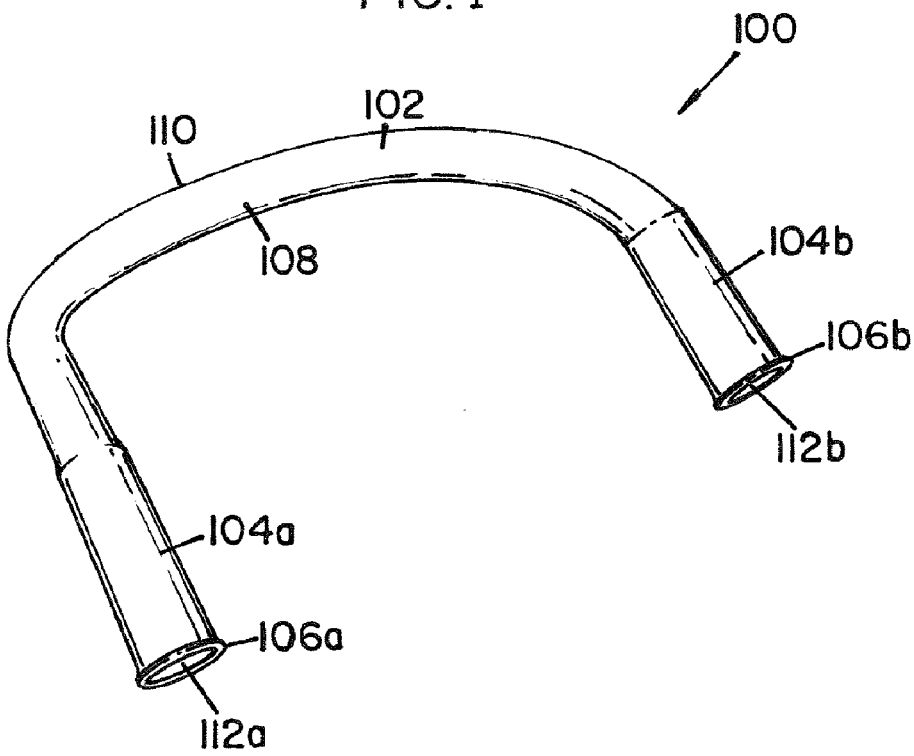
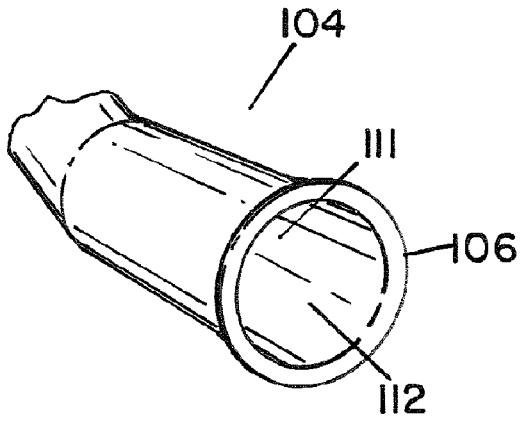
FIG.2

FIG. 3
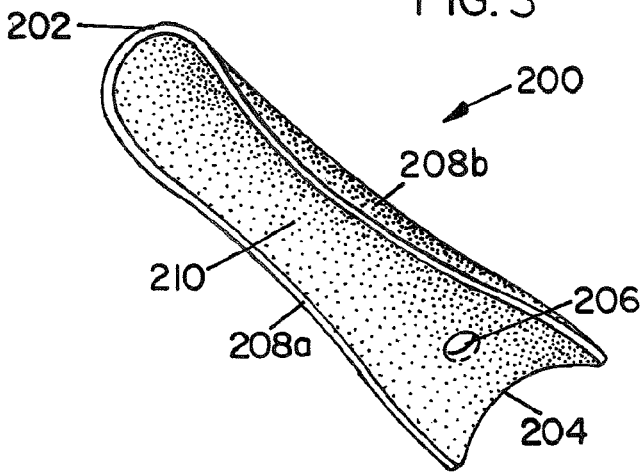
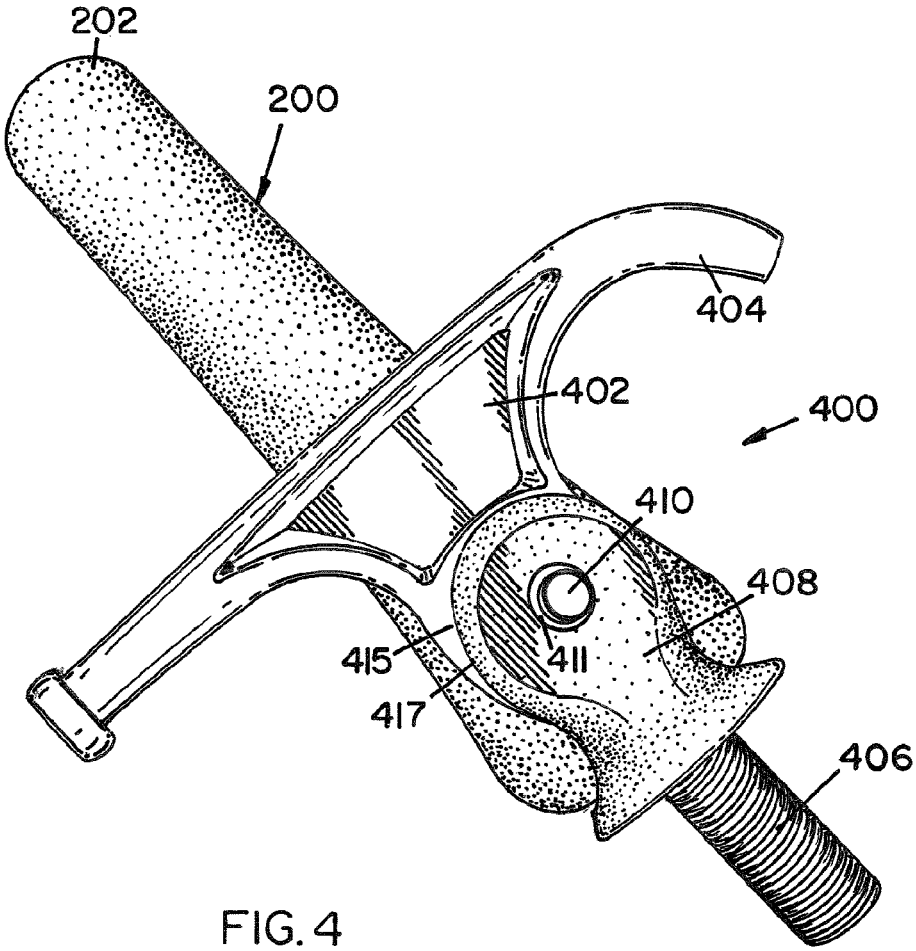
FIG. 4

FIG.17
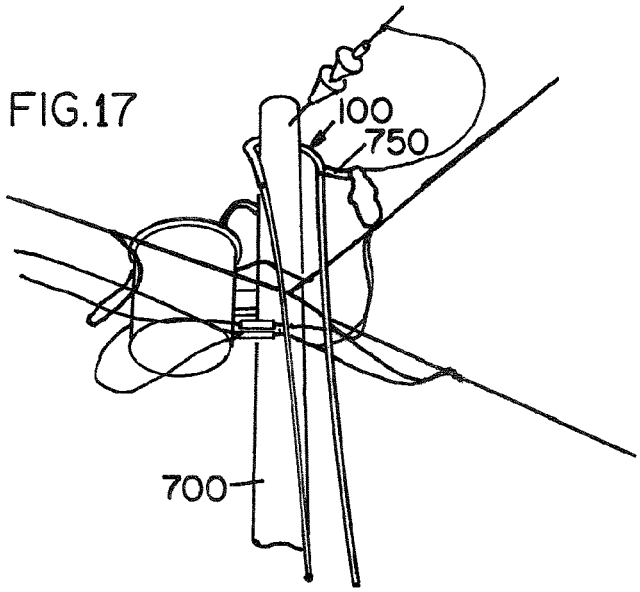
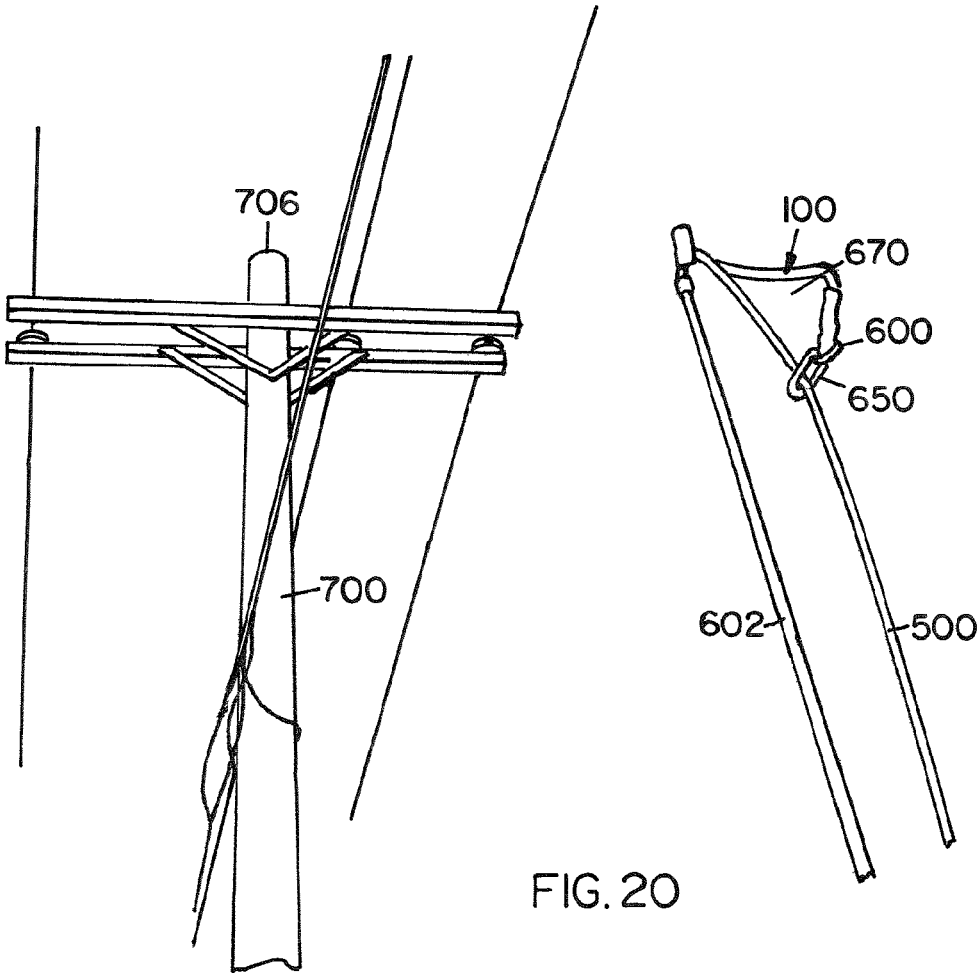
FIG. 20

FIG. 19
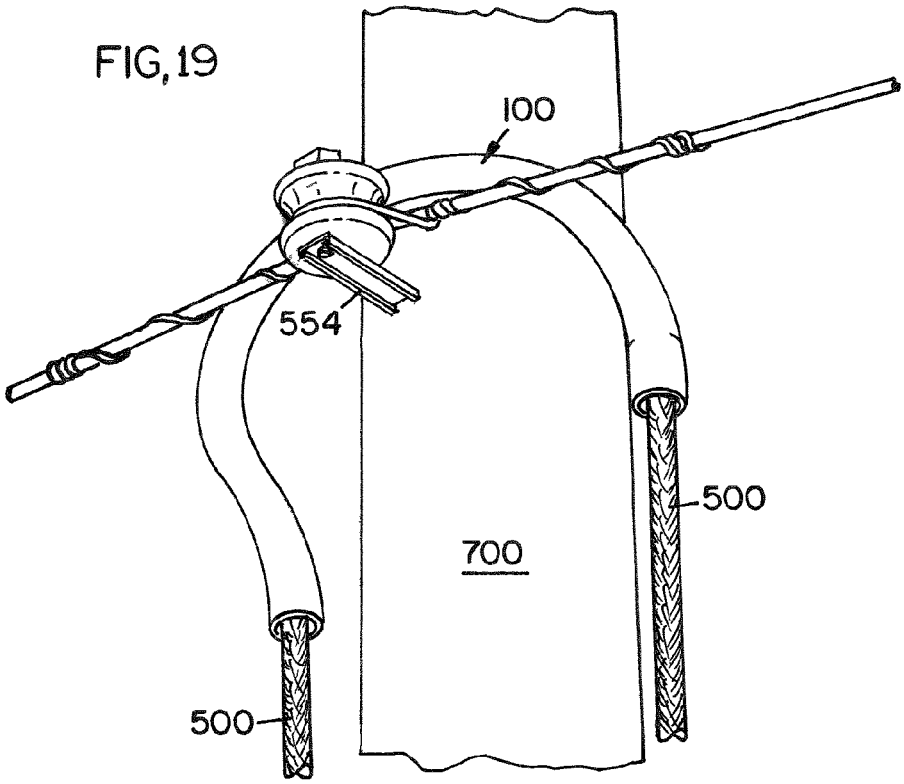
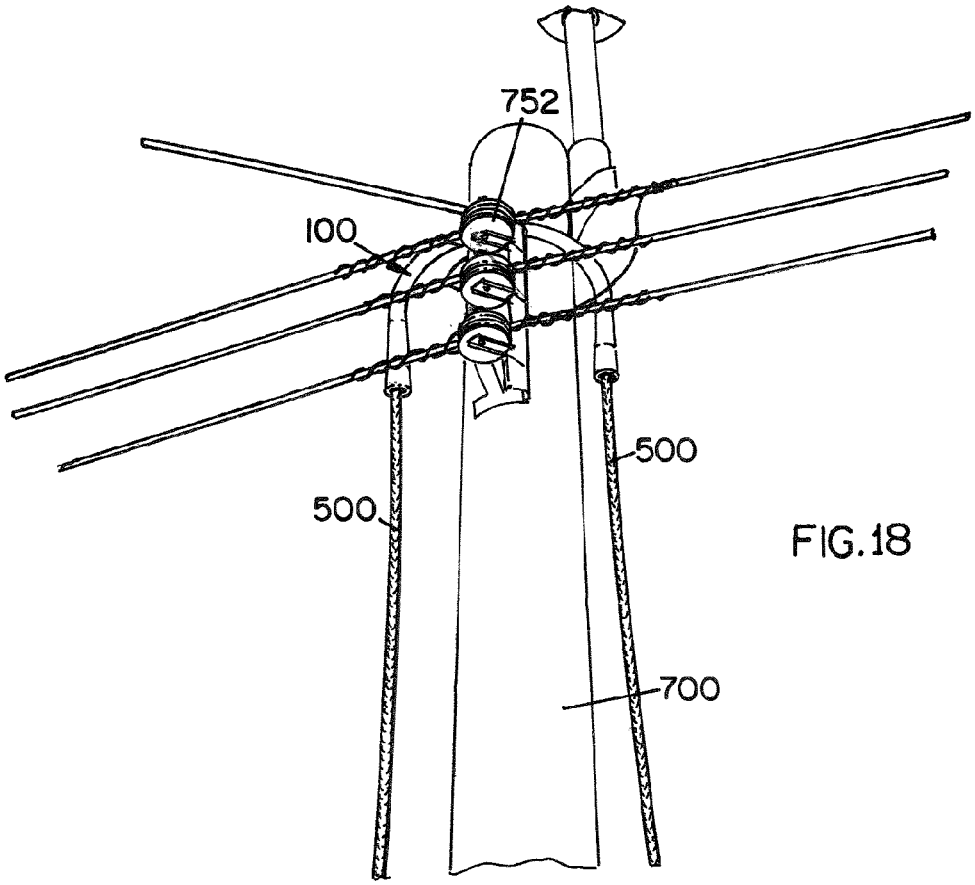
FIG. 18

POLE SAFETY ASSEMBLY

CROSS REFERENCE TO RELATED APPLICATIONS

The present application claims priority to Provisional Patent Application No. 61/173,241 filed on Apr. 28, 2009, having the same title herein and Provisional Application No. 61/208,351 filed on Feb. 24, 2009, having the title "Rope Positioning Device (RPD) and Attachment Tool" both of which are incorporated in their entirety herein.

BACKGROUND

Utility poles and other tall structures having devices such as utility services coupled high up require workers to access the devices for repairs and updates. Protecting workers from falling off utility poles, trees, towers and other structures is a challenging and sometimes complicated task. Traditional fall protection methods require using systems that are tailored to each application. Poles are climbed with a variety of different belts that cinch around the pole if the user falls. They require a climber to disconnect and reconnect around every obstruction in the climber's path which creates a fall risk. Ropes are often thrown over the limbs and structures while knots and hitches serve as rigging to support the workers weight. Furthermore, specialized equipment requires an abundance of skill and knowledge to inspect it and become proficient with using it safely.

For the reasons stated above and for other reasons stated below which will become apparent to those skilled in the art upon reading and understanding the present specification, there is a need in the art for an efficient and effective safety assembly that is used when climbing tall structures.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a safety assembly that provides a lifeline for utility poles and other tall structures is provided. The safety assembly includes a tubular member and a positioning member. The tubular member has first and second openings to a passage. The passage is configured to receive a rope. The positioning member has a first end and second end. The first end of the positioning member is configured to be received in at least one of the first and second openings of the tubular member. The second end of the positioning member is configured to be coupled to a reaching member. With the use of the positioning member and the reaching member, the tubular member is positioned to engage the tall structure and the rope passing through the internal passage is used as a lifeline.

BRIEF DESCRIPTION OF THE DRAWINGS

The present invention can be more easily understood and further advantages and uses thereof more readily apparent, when considered in view of the detailed description and the following figures in which:

FIG. 1 is a front perspective view of a tubular member of one embodiment of the present invention;

FIG. 2 is a close up view of an end of the tubular member of FIG. 1;

FIG. 3 is a front perspective view of a positioning member of one embodiment of the present invention;

FIG. 4 is a back view of the positioning member of FIG. 3 coupled to a tool head assembly of one embodiment of the present invention;

FIG. 17 illustrates the positioning of a tubular member on a utility pole in one embodiment of the present invention;

FIG. 18 illustrates another positioning of the tubular member on a utility pole of one embodiment of the present invention;

FIG. 19 illustrates yet another positioning of the tubular member on a utility pole of one embodiment of the present invention;

FIG. 20 illustrates another configuration of a pole safety assembly of one embodiment of the present invention.

In accordance with common practice, the various described features are not drawn to scale but are drawn to emphasize specific features relevant to the present invention. Reference characters denote like elements throughout Figures and text.

DETAILED DESCRIPTION

Figure 5:
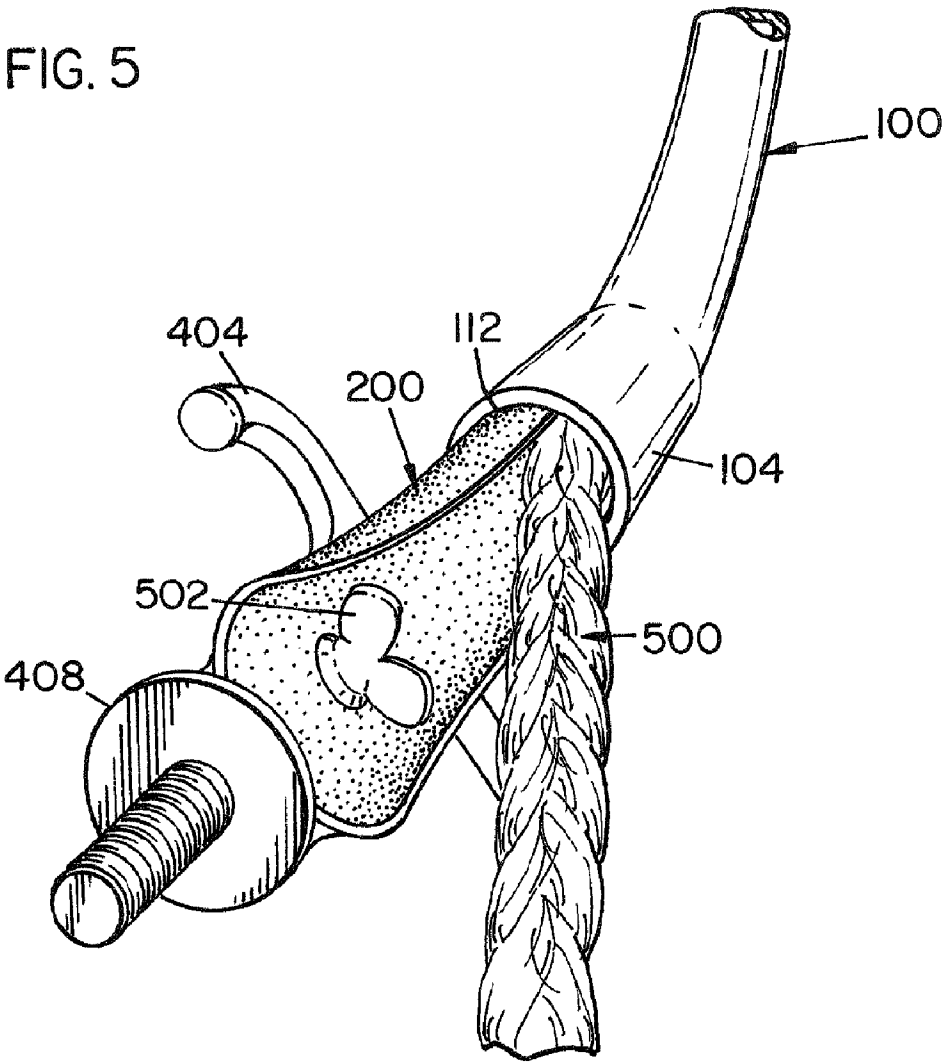
FIG. 5 illustrates an embodiment of a positioning member engaging a tubular member of the present invention.

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide a pole safety assembly that allows for the easy and effective placement of a lifeline on a structure that needs to be climbed. The pole safety assembly includes a tubular member 100 as illustrated in FIG. 1. The tubular member 100 in the embodiment of FIG. 1 is generally in a U-shape. The tubular member 100 is made from a generally strong-ridged-durable material that is generally lightweight such as, but not limited to, high impact plastic composite, poly carbonate plastic, polyvinyl chloride (PVC) pipe, chlorinated polyvinyl chloride (CPVC) pipe, TICPR, aluminum and titanium. Although the tubular member 100 is U-shaped in FIG. 1, any shape and size can be used depending on structural configurations around which the tubular member 100 needs to fit. Hence the shape could be dependant on its application. The tubular member 100 includes an internal passage that is accessed by openings 112A and 112B in ends 104A and 104B respectively. The tubular member 100 further has a mid portion 102 that extends between ends 104A and 104B. The mid portion 102 includes an engaging side 108 that abuts a structure when in use. The mid portion 102 further includes a back side 110 that along with the engaging side 108 provides support and rigidity of the device. The ends 104A and 104B are generally flared or bell shaped. In the embodiment of FIG. 1, lips 106A and 106B define the openings 112A and 112B to the internal passage. A close up view of one of the ends 104A and 104B generally indicated as end 104 is illustrated in FIG. 2. As FIG. 2 illustrates, in this embodiment, lip 106 flares out from the bell shaped end 104. In particular, lip 106 defines the opening 112 into the internal passage 111. In embodiments, a rope is passed through the internal passage 111 as described below.

Referring to FIG. 3, a positioning member 200 of the pole safety assembly of one embodiment is illustrated. The positioning member 200 is used to engage the tubular member 100 when positioning the tubular member 100 for use on a structure. The positioning member 200 includes a tapered engaging end 202 and a shoulder end 204. The engaging end 202 is designed to fit in an opening 112A or 112B of the tubular member 100. The shoulder end 204 includes an attaching aperture 206 that is further described below. In the embodiment of FIG. 3, rolled side walls 208A and 208B form the tapered cone shaped engaging end 202 that is received in the respective openings 112A and 112B of the tubular member 100. A mid portion 210 of the positioning member 200 extends between the engaging end 202 and the shoulder end 204. The positioning member 200 is made from a material that is rigid and capable of supporting the tubular member including, but not limited to, stamped, cast or milled material such as aluminum, plastic, carbon fiber or nylon.

In one embodiment, the positioning member 200 is attached to a tool head assembly 400 as illustrated in FIG. 4. The tool head assembly 400 in this embodiment includes a working end 402 having a hook portion 404. Rotationally attached to the working end 402 is a base portion 408. In the embodiment of FIG. 4, working end 402 includes a first set of teeth 415 that engage a second set of teeth 417 on the base portion 408. A threaded fastener 410 passing through a threaded bore 411 in the base portion 408 and a bore in the working end 402 couples the base portion 408 to the working end 402. Further the threaded bore 411 of the base portion 408 is also aligned with attaching aperture 206 of the positioning member 200. The threaded fastener 410 passes through aperture 206 of the positioning member 200 and is threadably engaged with the threaded bore 411 in the tool head assembly 400 to attach the positioning member 200 to the tool head assembly 400. The base portion 408 of the tool head assembly 400 further includes a threaded shaft 406 that is designed to engage a threaded bore in an end of a reaching member such as a non-conductive extension stick hotline tool commonly used in the utility industry and commonly referred to as a "hot stick." In one embodiment, the positioning member 200 and tool head assembly 400 are one solid piece.

Figure 6:
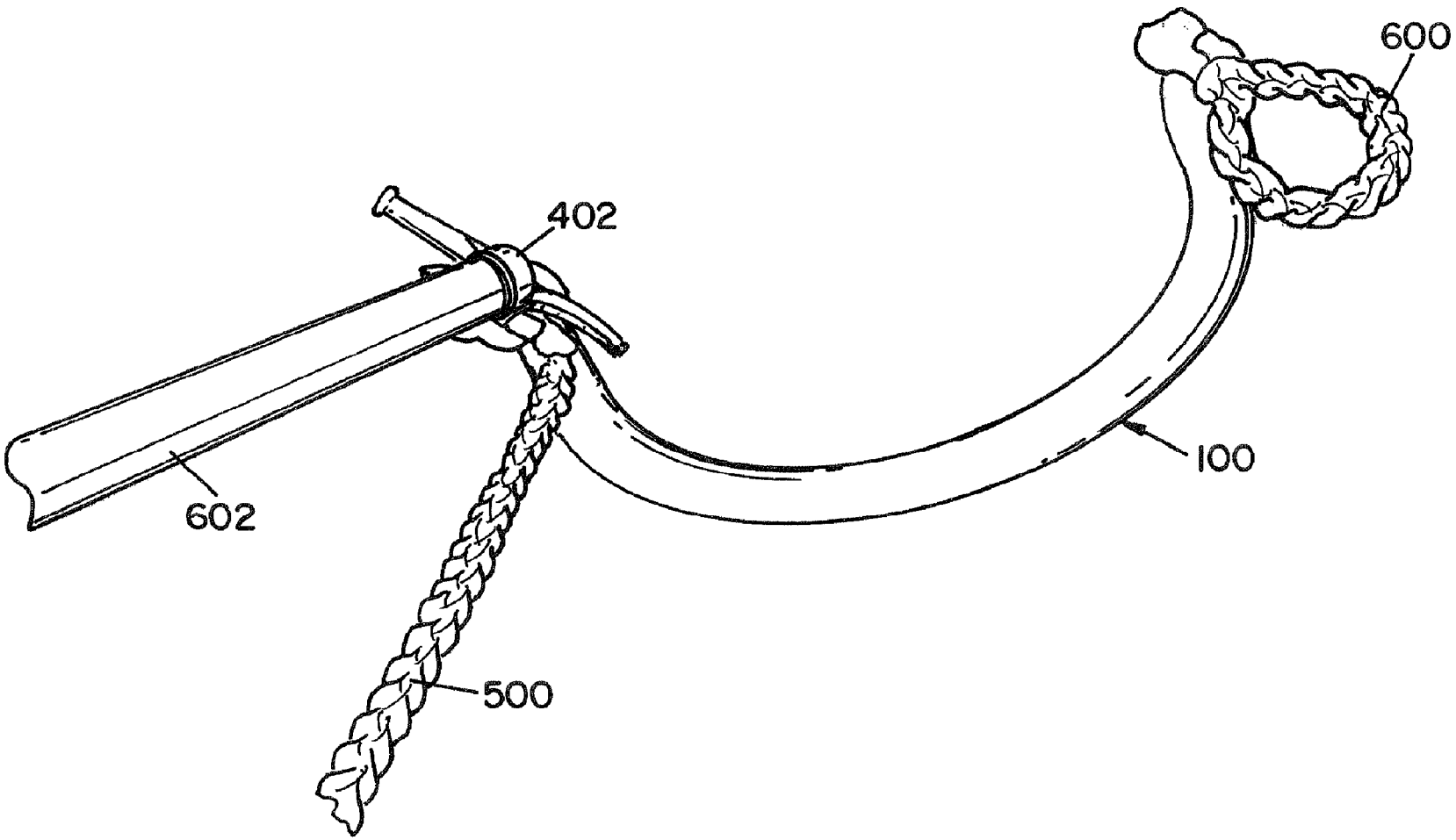
FIG. 6 illustrates a positioning member coupled to a reaching member and engaged with a tubular member of one embodiment of the present invention.
Figure 7:
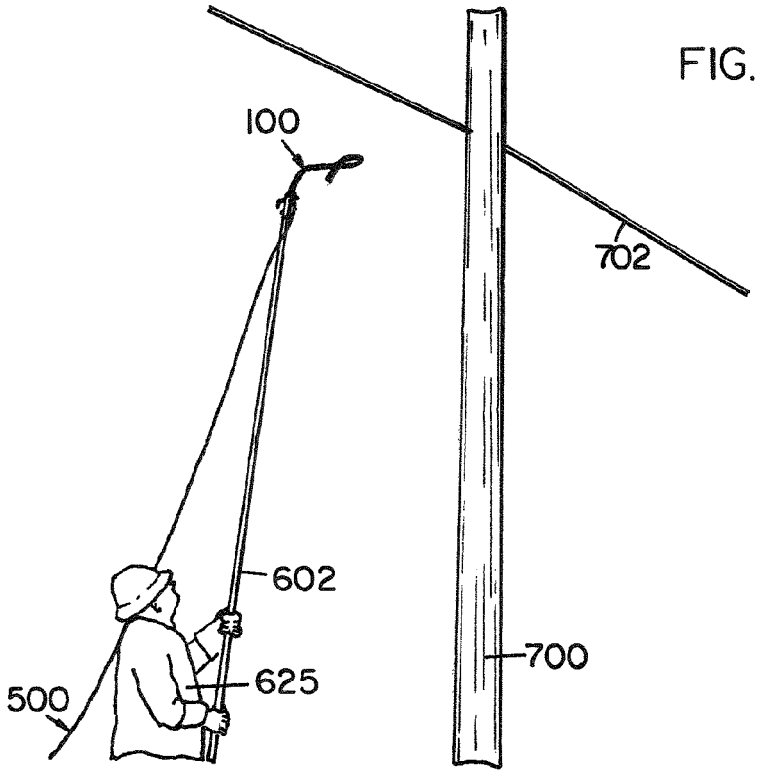
FIG. 7 further illustrates a reaching member positioning a tubular member on a utility pole of one embodiment of the present invention.
Figure 8:
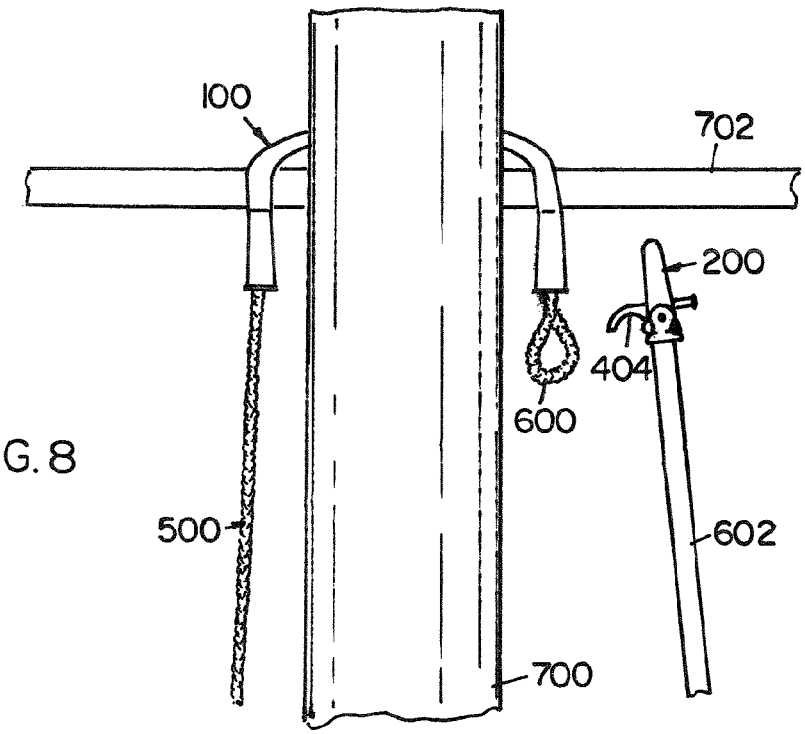
FIG. 8 is a front view illustrating a tubular member positioned on a utility pole and a reaching member with a hook portion of one embodiment of the present invention.
Figure 9:
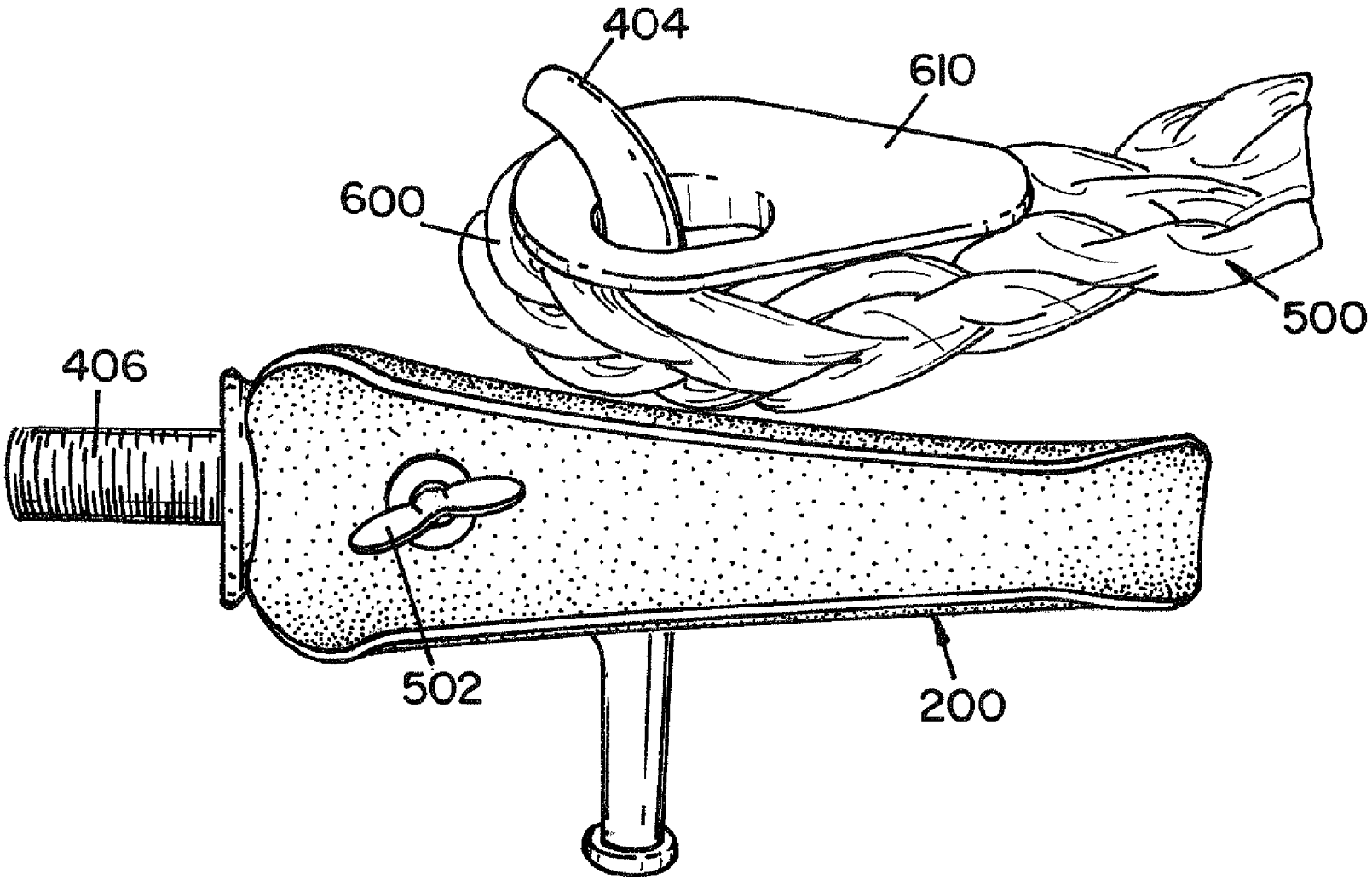
FIG. 9 is a front-close up view of the hook portion of the reaching member received in a loop of a rope of one embodiment of the present invention.

FIG. 5 illustrates the poisoning member 200 being received into an opening 112A or 112B in the tubular member 100. As illustrated, a rope 500 is received through the internal passage 111 of the tubular member 100. When the positioning member 200 is received through the opening 112A or 122B, the rope 500 is received in the cone formed by the rolled side walls 208A and 208B of positioning member 200. The rope 500 may be made of nylon or any other commonly used material. Moreover, the rope 500 could also be a wire or any other elongated member or lifeline. Also illustrated in FIG. 5, is a manipulation portion 502 of the threaded fastener 410 that is used to couple the positioning member 200 to the tool head assembly 400. In one embodiment, the fastener 410 is a thumb screw. In FIG. 6, an illustration of the tool head assembly 400 coupled to a reaching member 602 with the positioning member 200 engaged with the tubular member 100. Also illustrated in FIG. 6, is rope 500 having a loop 600 which is described further below. FIG. 7, illustrates a user 625 positioning the tubular member 100 with the use of a reaching member 602 on a utility pole 700. Once the tubular member 100 has been positioned, the positioning member 200 is removed from the internal passage 111 of the tubular member 100. This is illustrated in FIG. 8 where the tubular member 100 has been positioned about a utility pole 700 and is supported in place by cross-member 702 of the utility pole 700. In an embodiment, once the tubular member 100 has been positioned, the hook portion 404 of the tool head assembly 400 is placed within the loop 600 of the rope 500. Once the hook portion 404 is within the loop 600, it is used to pull the rope 500 down as the reaching member 602 is retracted back towards the user. FIG. 9 illustrates the hook portion 400 of the tool head assembly 400 positioned within the loop 600. In this embodiment, a rope protector 610 is positioned within the loop 600 to help prevent wear of the rope 500 within the loop 600 and strengthen the rope.

Figure 11:
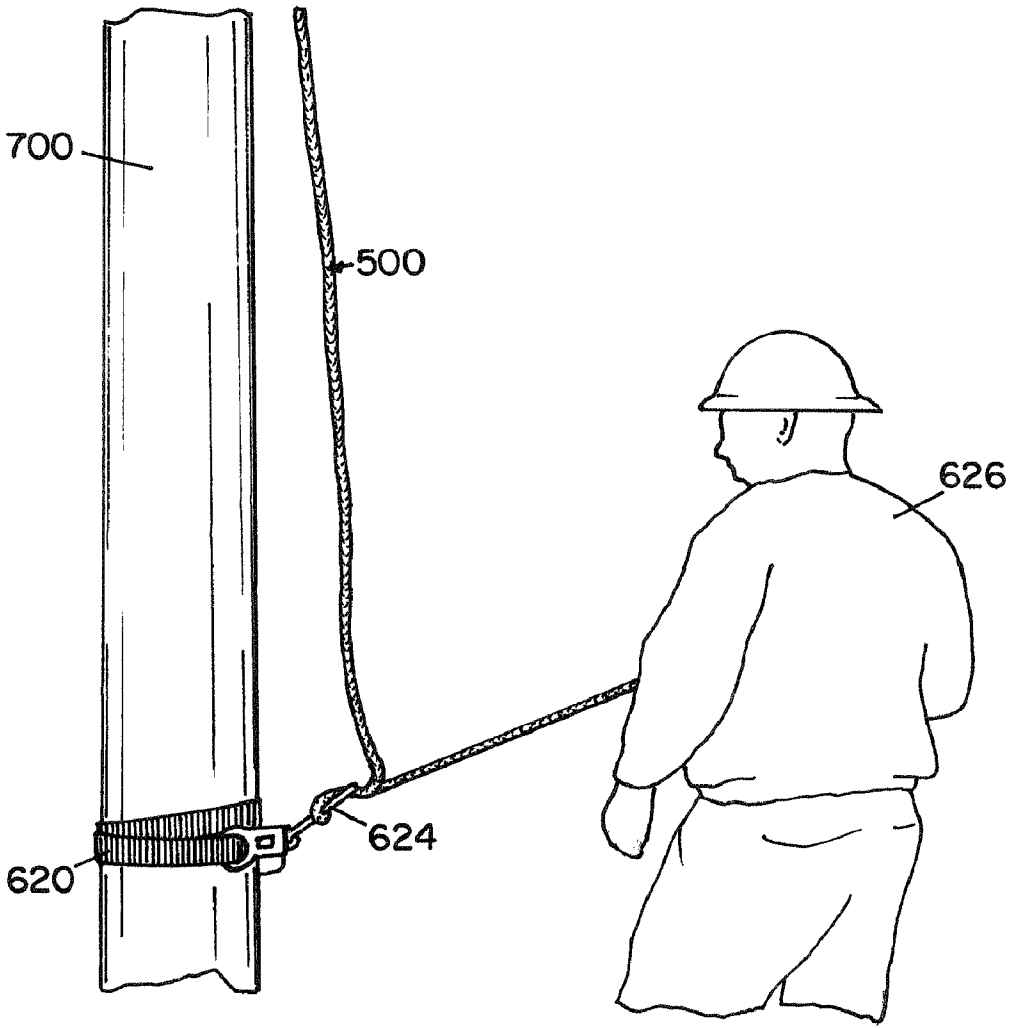
FIG. 11 illustrates a belay system of one embodiment of the present invention.
Figure 10:
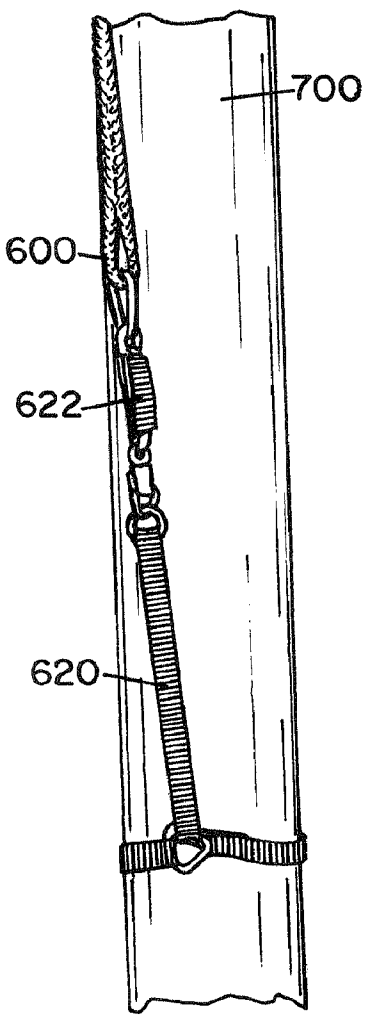
FIG. 10 illustrates a connection of a rope to a pole of one embodiment of the present invention.

Referring to FIG. 10, an illustration of how the looped end of the rope 500 is secured in one embodiment is illustrated. In this embodiment, the looped 600 is coupled to a shock absorber 622, such as but not limited to, an energy absorber used with lanyards in the fall protection industry. The shock absorber 622 is in turn coupled to a connection strap 620 that is sling choked around the pole 700. In another embodiment, a shock absorber is not used proximate the connection to the support (pole 700). Although, the connection strap 620 is illustrated as being connected to the pole in FIG. 10, it will be understood that the connection strap 620 can be coupled to any available secure support structure. The connection strap 620 (or continuous loop sling) in one embodiment, is designed to be cut in the event of an emergency. In another embodiment, the connecting strap 620 is a chain. Another method of connecting the looped end is illustrated in FIG. 11, where the connection strap 620 is used as an anchor point for a belay 624 to form a belay system. The belay system includes the rope 500 wound around the belay 624 that is controlled by user 626 to control the descent of a person connected to the rope 500.

Figure 14:
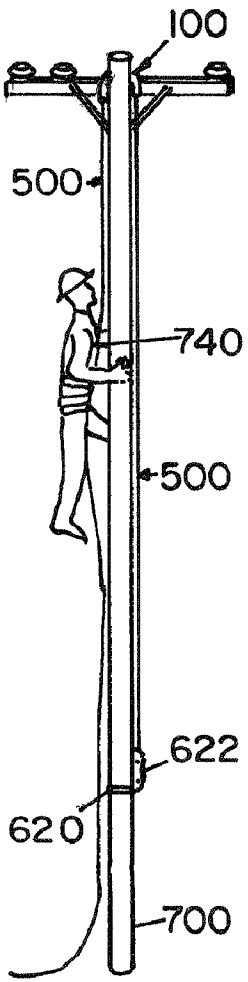
FIG. 14 illustrates a pole safety assembly in use with a sternal connection of another embodiment of the present invention.
Figure 12:
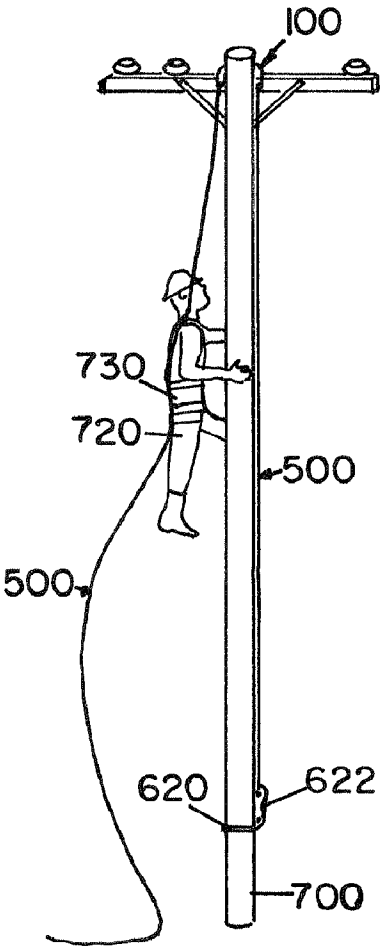
FIG. 12 illustrates a pole safety assembly in use of one embodiment of the present invention.
Figure 13:
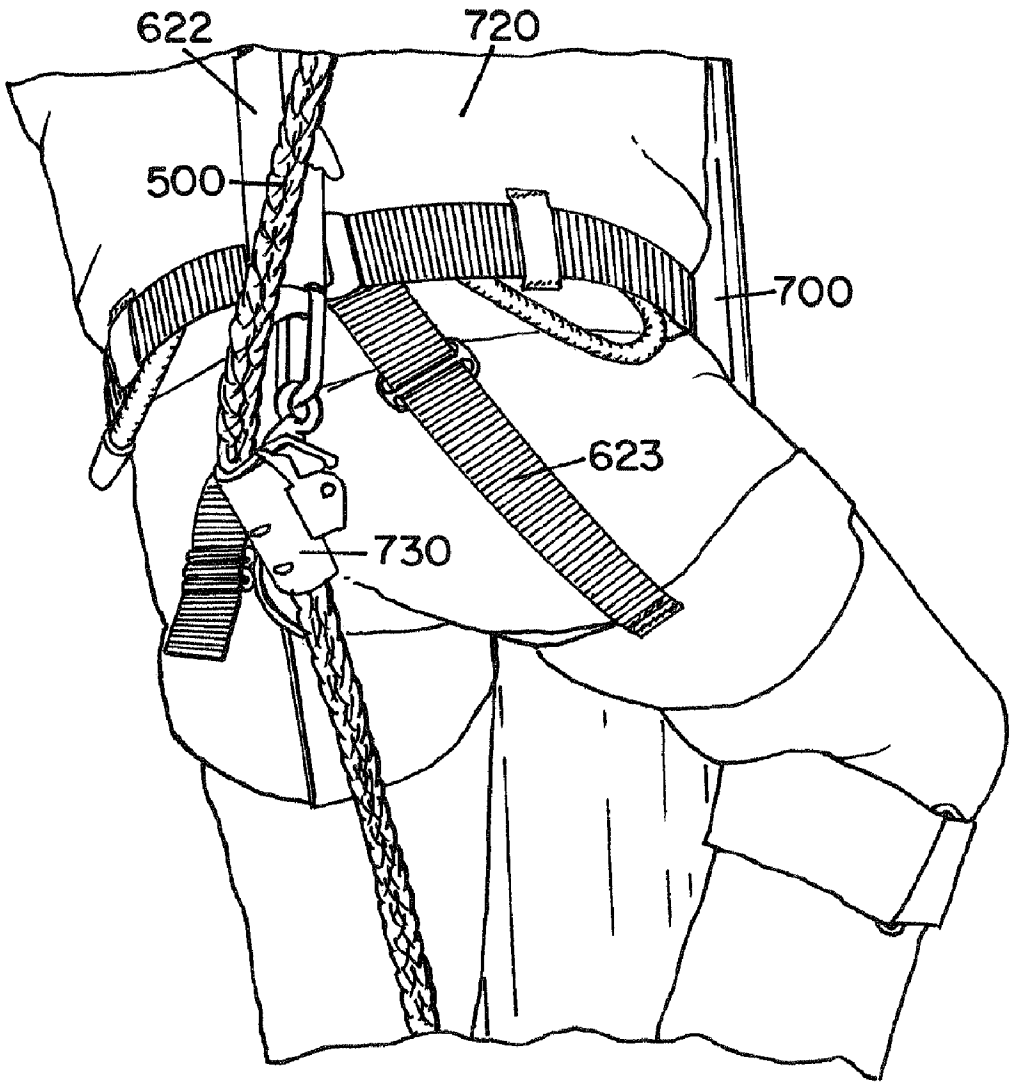
FIG. 13 is a close up view illustrating a rope grab in use with the pole safety assembly of one embodiment of the present invention.
Figure 16:
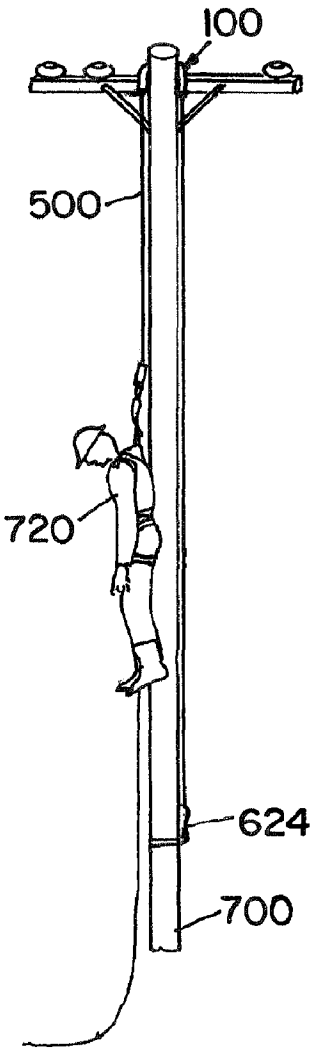
FIG. 16 illustrates a pole safety assembly during a fall event of an embodiment of the present invention.
Figure 15:
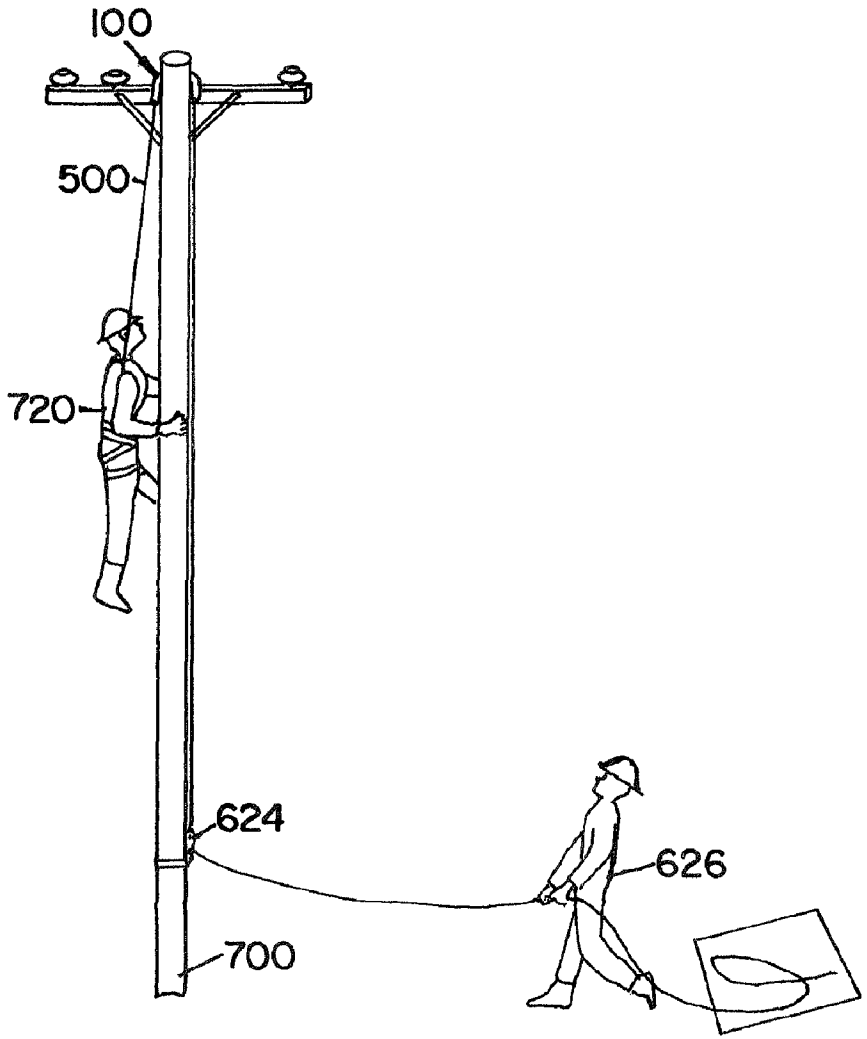
FIG. 15 illustrates a pole safety assembly in use with a belay system of another embodiment of the present invention.

Once the rope 500 is secured to the utility pole 700 a user can use it for a safety line. An example of its use is illustrated in FIG. 12. As illustrated in FIG. 12, the rope 500 passing through the tubular member 100 and coupled to a utility pole 700 via shock absorber 622 and connection strap 620 is used as a vertical safety line. In FIG. 12, a rope grab 730 that is coupled to a climber 720 is used. A close up view of the rope grab 730 is illustrated in FIG. 13. In the embodiment of FIG. 13, the rope grab 730 is coupled to a shock absorber 622 which in turn is coupled to a D-ring (not shown) of a fall protection harness 623. In use, as the climber 720 climbs the pole 700, the rope 500 passes through the rope grab 730. If the climber 720 slips, the movement of the rope 500 in the rope grab 730 causes the rope grab 730 to clamp down on the rope 500 to prevent the climber 720 from falling. FIG. 14 illustrates a sternal connection 740 of one embodiment. In one embodiment a sternal rope grab 740 connection is used. FIG. 15 illustrates a belay system of an embodiment. As illustrated, the climber 720 is coupled to the rope 500 and climbs the pole 700. Meanwhile user 626 pulls on the rope through the belay device 624 to keep the rope 500 taunt in case of a fall of the climber 720. If the climber 720 falls, the user 626 then simply lowers the climber 720 by slowly paying out the rope. An example of a climber 720 that has slipped but was prevented from falling by a safety assembly is illustrated in FIG. 16. A few different configurations using rope 500 as a lifeline with a tubular member 100 is illustrated above. Other types of lifeline configurations are contemplated and the present invention is not limited to those examples provided.

The tubular member 100 was illustrated in the FIG. 8 as being supported on the pole 700 by a cross member 702. However, a cross member 702 is not required in all applications. The only requirement is that an object used for support must be sturdy enough to hold the weight of the climber during a fall event. For example, referring to FIG. 17, support for the tubular member 100 about the pole 700 is provided by a cutout bracket 750. Referring to FIG. 18, support for the tubular member 100 is provided by a three spool secondary rack 752. Referring to FIG. 19, support for the tubular member 100 is provided by a secondary clevis 554. Hence, various objects can be used for support of the tubular member 100 and the rope 500.

Figure 21:
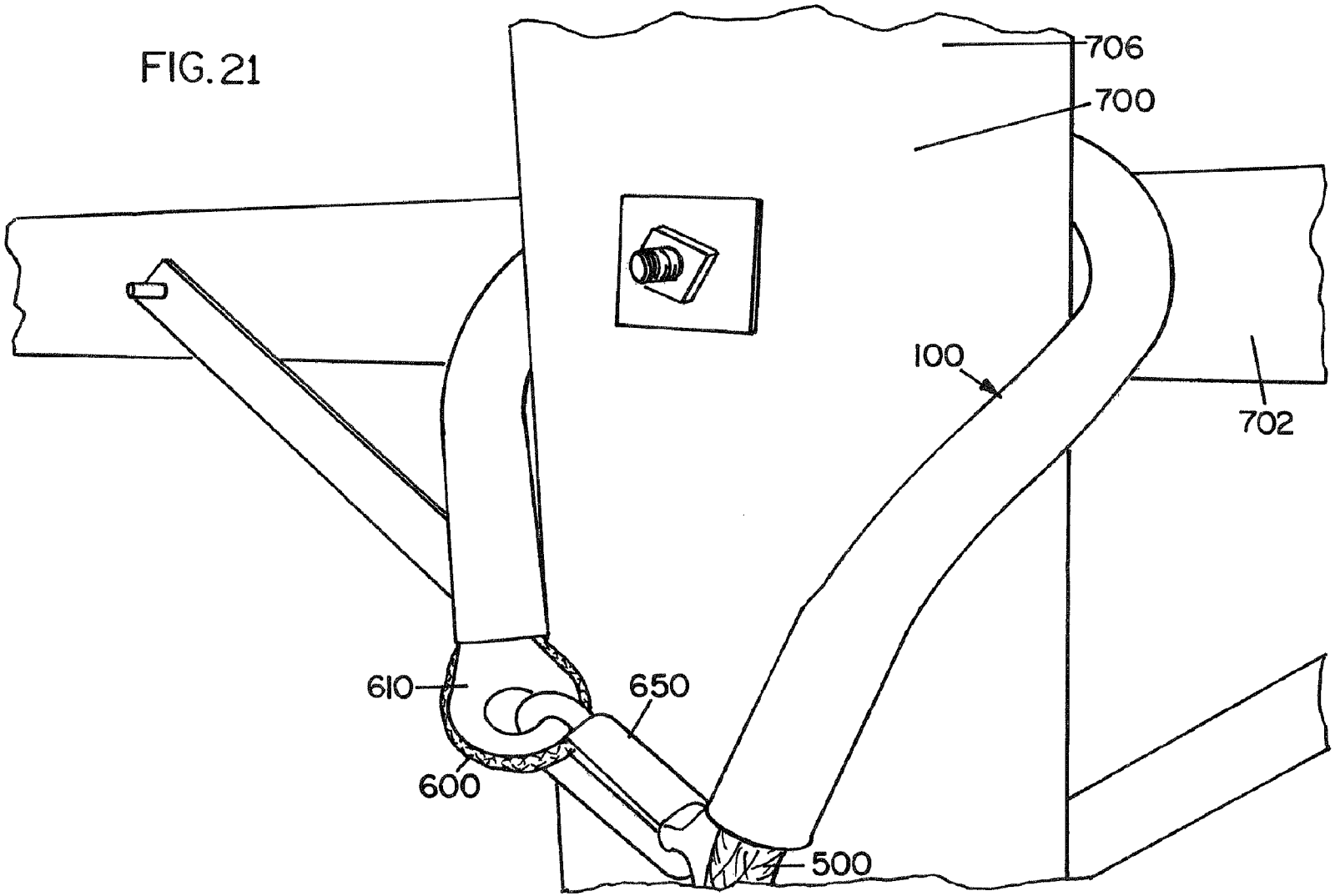
FIG. 21 illustrates a connection of the tubular member about a utility pole in relation to the configuration of the pole safety assembly of FIG. 20.

Referring to FIG. 20 another method of using the tubular member 100 for a safety line is illustrated. In this example, the rope 500 passing through the internal passage 111 of the tubular member 100 is coupled together via connection member 650. In particular, the connection member 650 connects the loop 600 coming out of opening 112B of the tubular member 100 to an interned portion of the rope 500 coming out of the opening 112A. This in turn forms a connecting loop 670. The connecting loop 670 is then placed over a top portion 706 of the pole 700 with the use of a reaching member 602. FIG. 21 illustrates a tubular member 100 using this configuration that is coupled around pole 700. As illustrated, the connecting member 650 couples the tubular member 100 about the pole 700. In one embodiment, the connection member 650 is a carabiner. Cross member 702 retains the tubular member 100 in place on the pole 700. Hence, the tubular member 100 can be used in different configurations. Moreover, as discussed above the shape of the tubular member 100 is not limited to generally a U-shape. The shape of the tubular member 100 can be any form that allows it to be used for a particular application. Hence, although, the tubular member 100 is illustrated as applying to a pole, other types of tall structures can be used that require a different shaped tubular members.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A safety assembly comprising:

a curved tubular member having first and second openings to a passage, the passage configured to receive a rope therethrough, at least one of the first and second openings being flared out to provide at least one opening that is larger than the passage; and a positioning member having a first end and a second end, the first end of the positioning member configured to be selectively received in the at least one of the first and second openings of the tubular member that is flared out, the second end of the positioning member configured to be coupled to a reaching member.

2. The safety assembly of claim 1, wherein the tubular member is flared out proximate to both the first and second openings.

3. The safety assembly of claim 1, wherein the tubular member includes lips proximate the first and second openings.

4. The safety assembly of claim 1, wherein the tubular member is generally U-shaped.

5. The safety assembly of claim 4, wherein the U-shaped tubular member is so dimensioned as to fit around a structure to which it is to be applied.

6. The safety assembly of claim 1, wherein the first end of the positioning member is tapered.

7. The safety assembly of claim 6, wherein the positioning member further includes first and second rolled sidewalls that form the tapered first end.

8. The safety assembly of claim 1, wherein the positioning member further includes an attaching aperture proximate the second end used to connect the positioning member to the reaching member.

9. A safety assembly comprising:

a curved tubular member having a first end and a second end, the first and second ends further having first and second openings to an internal passage in the tubular member, at least one of the first and second ends being flared to provide a larger opening than the internal passage;

a rope passing through the internal passage of the tubular member; and a positioning member having a first side wall and a second side wall, the first sidewall and the second sidewall rolled to form a tapered coned shaped engaging end that selectively fits into at least one of the first and second openings of the tubular member.

10. The safety assembly of claim 9, further comprising:

an elongated reaching member having a connecting end; and the positioning member further having an attaching end that is selectively coupled to the connecting end of the elongated reaching member.

11. The safety assembly of claim 10 further comprising:

a hook portion coupled to the elongated reaching member proximate the connecting end.

12. The safety assembly of claim 9, wherein the tubular member is generally U-shaped.

13. The safety assembly of claim 9, wherein the rope includes an end with a loop.

14. The safety assembly of claim 9, further comprising:

a shock absorber configured to be selectively coupled to an end of the rope; and a connection strap having a first end configured to be coupled to a secure structure and a second end configured to be coupled to the shock absorber.

15. The safety assembly of claim 9, further comprising:

a belay system configured to be selectively coupled to an end of the rope.

16. The safety assembly of claim 9, further comprising:

a rope grab configured to grab the rope in response to a fall event.

17. The safety assembly of claim 16, further comprising:

a shock absorber coupled between the rope grab and a safety harness.

18. A safety assembly comprising:

a shaped tubular member having a passage and first and second flared ends terminating in respective first and second openings to the passage, wherein the shaped tubular member is generally U-shaped;

a rope positioned with the passage, the rope having a looped end;

a positioning member having a first side wall and a second side wall, the first sidewall and the second sidewall rolled to form a tapered coned shaped engaging end that selectively fits into at least one of the first and second openings of the tubular member;

an elongated reaching member having a first end coupled to a connecting end of the positioning member; and a hook portion coupled proximate the first end of the elongated member to selectively engage the looped end of the rope.

19. The safety assembly of claim 18, further comprising:

a rope grab to receive the rope and grab the rope in response to a fall event.

20. The safety assembly of claim 18, further comprising:

a shock absorber configured to be selectively coupled to an end of the rope; and a connection strap having a first end configured to be coupled to a secure structure and a second end configured to be coupled to a shock absorber.

* * * * *